US011565296B2

(12) United States Patent
Badegruber et al.

(10) Patent No.: US 11,565,296 B2
(45) Date of Patent: Jan. 31, 2023

(54) LOWER TOOL WITH FRICTION REDUCTION DEVICE

(71) Applicant: TRUMPF Maschinen Austria GmbH & Co. KG, Pasching (AT)

(72) Inventors: Karl Badegruber, Fischlham (AT); Alfred Haselboeck, Rohrbach (AT); Heinz Leumueller, Linz (AT); Kabir Secibovic, Gunskirchen (AT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 0 days.

(21) Appl. No.: 17/046,508

(22) PCT Filed: May 6, 2019

(86) PCT No.: PCT/AT2019/060152

§ 371 (c)(1),
(2) Date: Oct. 9, 2020

(87) PCT Pub. No.: WO2019/213681

PCT Pub. Date: Nov. 14, 2019

(65) Prior Publication Data

US 2021/0107049 A1 Apr. 15, 2021

(30) Foreign Application Priority Data

May 7, 2018 (AT) ..... A 50379/2018

(51) Int. Cl.
*B21D 37/14* (2006.01)
*B21D 5/04* (2006.01)
*B21D 5/02* (2006.01)

(52) U.S. Cl.
CPC ..... *B21D 5/0236* (2013.01); *B21D 37/14* (2013.01); *B21D 5/0254* (2013.01); *B21D 5/04* (2013.01)

(58) Field of Classification Search
CPC ..... B21D 37/04; B21D 37/14; B21D 5/0209; B21D 5/0236; B21D 5/0254;
(Continued)

(56) References Cited

U.S. PATENT DOCUMENTS 4,137,746 A * 2/1979 Arnhold ..... B21D 5/0209 72/389.3
4,317,358 A 3/1982 Yonezawa et al.
(Continued)

FOREIGN PATENT DOCUMENTS

CN 104507596 A 4/2015
CN 107791576 A * 3/2018 ..... B30B 15/00
(Continued)

OTHER PUBLICATIONS

International Search Report in PCT/AT2019/060152, dated Oct. 17, 2019.

*Primary Examiner* — Shelley M Self
*Assistant Examiner* — Jared O Brown
(74) *Attorney, Agent, or Firm* — Collard & Roe, P.C.

(57) ABSTRACT

A lower tool for a bending machine, in particular die bending machine, includes a longitudinally extended base body, which has, on its bottom side, a tool shank for being received in a guide slot of a tool holder and optionally tool shoulders in the transverse direction, and at least one friction reduction device on the bottom side of the base body for reducing a frictional force between the bottom side and the tool holder in the event of a displacement of the lower tool in the longitudinal direction, wherein the at least one friction reduction device is configured such that a weight force of the lower tool acting on the tool holder, while applying a prestressing force in the direction of the weight force, causes a resulting normal force of the lower tool onto the tool holder that is lower relative to the weight force.

13 Claims, 5 Drawing Sheets

Figure 1:
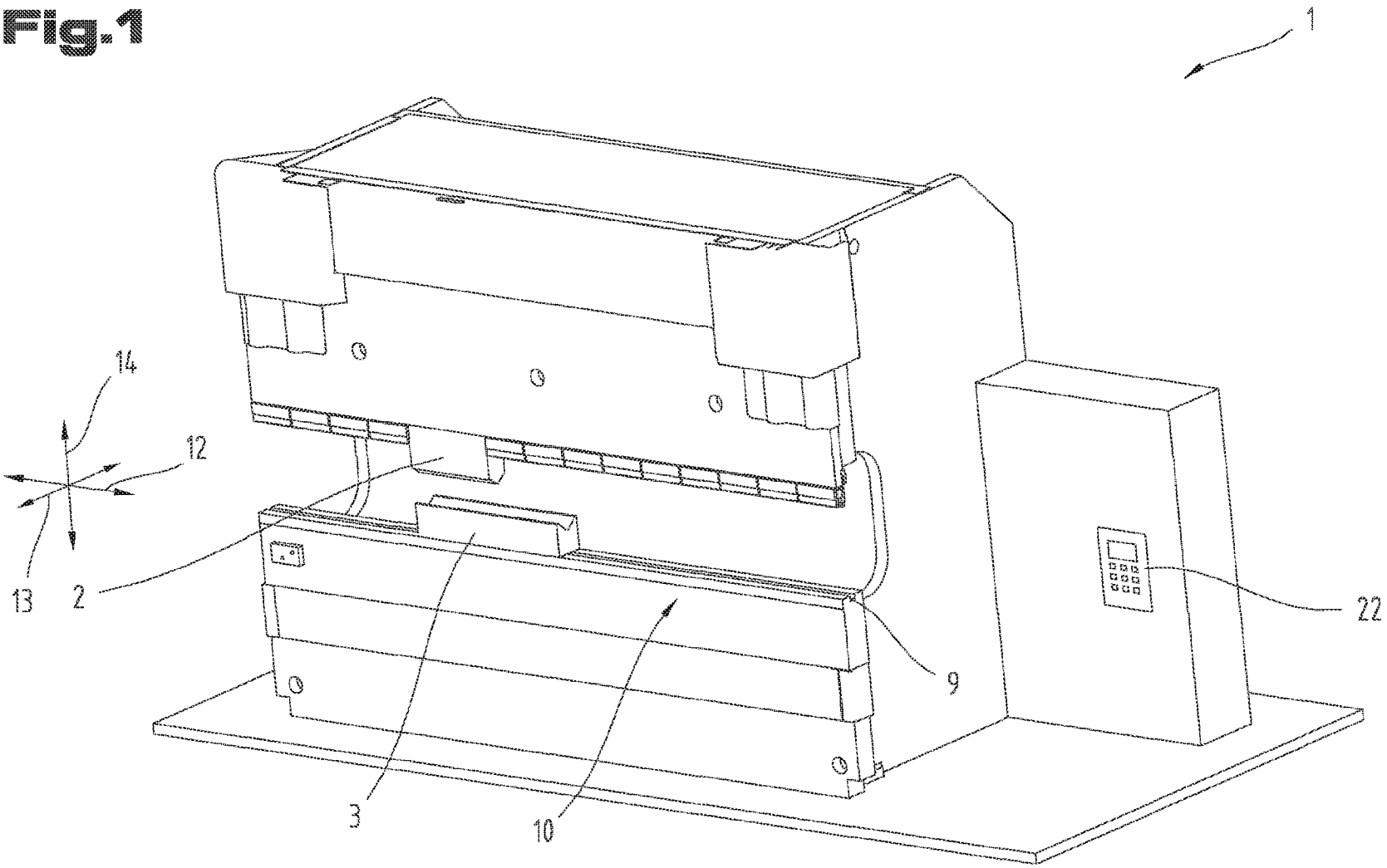

(58) Field of Classification Search
CPC .... B21D 5/0227; B21D 5/002; B21D 26/031; B21D 28/325; B30B 15/02; B30B 15/026; B30B 15/028; B30B 15/061; B23Q 3/155; B23Q 3/1552; B23Q 3/15553; B23Q 3/18; B23Q 3/186
USPC ..... 72/17.2, 20.1, 21.4
See application file for complete search history.

(56) References Cited

U.S. PATENT DOCUMENTS

| | | | | |
|---|---|---|---|---|
| 4,367,644 | A | 1/1983 | Kramer et al. | |
| 4,895,014 | A * | 1/1990 | Houston | B21D 37/04 72/481.2 |
| 5,146,774 | A | 9/1992 | Smith | |
| 7,021,116 | B2 | 4/2006 | Harrington et al. | |
| 7,168,286 | B1 | 1/2007 | Pelech | |
| 7,584,640 | B1 * | 9/2009 | Liu | B21D 5/02 72/389.8 |
| 9,180,508 | B2 | 11/2015 | Bishop | |
| 10,144,049 | B2 | 12/2018 | Jansen et al. | |
| 2002/0104363 | A1 * | 8/2002 | Maida | B21D 5/0209 72/389.8 |
| 2005/0132772 | A1 | 6/2005 | Harrington et al. | |
| 2006/0107727 | A1 | 5/2006 | Pelech | |
| 2008/0307850 | A1 * | 12/2008 | Pabich | B29C 48/304 72/481.1 |
| 2012/0160002 | A1 * | 6/2012 | Bammer | B21D 5/0209 72/19.1 |
| 2014/0053624 | A1 * | 2/2014 | Wiklund | B21D 37/01 72/372 |
| 2015/0089990 | A1 * | 4/2015 | Lin | B21D 5/0209 72/476 |
| 2015/0143908 | A1 * | 5/2015 | Cetinkaya | G01M 13/028 73/579 |
| 2015/0165506 | A1 * | 6/2015 | Jansen | B21D 5/0227 72/476 |
| 2018/0304331 | A1 * | 10/2018 | Cavicchia | B21D 5/0218 |
| 2019/0134691 | A1 * | 5/2019 | Sundquist | B21D 5/0236 |

FOREIGN PATENT DOCUMENTS

| | | | | |
|---|---|---|---|---|
| DE | 60 2004 002 860 | T2 | 4/2007 | |
| DE | 20 2013 005 962 | U1 | 7/2013 | |
| EP | 2 399 687 | A1 | 12/2011 | |
| KR | 20040007046 | A * | 1/2004 | B21D 5/0209 |
| WO | 02/30589 | A1 | 4/2002 | |
| WO | 2014/007640 | A1 | 1/2014 | |
| WO | 2015/001454 | A1 | 1/2015 | |
| WO | 2017/067879 | A1 | 4/2017 | |

* cited by examiner

LOWER TOOL WITH FRICTION REDUCTION DEVICE

CROSS REFERENCE TO RELATED APPLICATIONS

This application is the National Stage of PCT/AT2019/060152 filed on May 6, 2019, which claims priority under 35 U.S.C. § 119 of Austrian Application No. A50379/2018 filed on May 7, 2018, the disclosure of which is incorporated by reference. The international application under PCT article 21(2) was not published in English.

The invention relates to a lower tool for a bending machine, in particular die bending machine, comprising at least one friction reduction device for reducing the frictional force between the bottom side of the lower tool and a tool holder.

In modern forming machines, in particular bending machines, it is often necessary to perform a tool change of an upper tool and/or a lower tool. In the course of this, the forming and/or bending tools are oriented to one another, optimally for the respective forming operation, on tool holders of the bending machine and can optionally be braced and/or clamped against an inadvertent displacement during the bending operation. Here, simple tool-changing systems, which, particularly in the case of lower tools, allow an effortless replacement, are of increasing significance. Lower tools usually have a longitudinally extended base body which, on its upper side, has a die mold designed for the respective forming operation. Such a lower tool usually has, on its bottom side, a tool shank which serves for being received in a guide slot of a tool holder. Oftentimes, tool shoulders are formed laterally in the transverse direction which is normal to the longitudinal direction of the base body. During a tool change, the dead weight of the lower tool and the weight force acting on the tool holder can, upon displacement of the lower tool along the tool holder, cause damage to the lower tool surface and/or to the tool holder surface.

In order to avoid damage to the lower tool surface and/or the surface of the tool holder, a number of technical solutions are already known from the prior art. By way of example, WO 2014/007640 is mentioned at this point. In this document, the formation of a separate gliding carriage, guided on rigid rollers, as a tool shank on the bottom side of the lower tool is described. Furthermore, the formation of the tool holder, by means of a guide channel of the tool holder, which guide channel is height-adjustable in the direction of loading, is necessary. This way, it is possible to raise the lower tool by activating a pneumatic system, whereby the tool shoulders lift off the tool holder and the lower tool becomes displaceable on the rigid rollers of the tool holder along the guide slot. The realization of this concept requires a relatively high technical effort, which causes increased costs in the production. The object of the present invention was to overcome the disadvantages of the prior art and to provide a lower tool having a friction reduction device, by means of which a user is able to perform a tool change in a relatively simple, cost-effective, safe and quick manner.

This object is achieved by means of a device and a method according to the claims.

The device according to the invention relates to a lower tool for a bending machine, in particular die bending machine, which comprises a longitudinally extended base body and at least one friction reduction device received therein or formed thereon. The base body has a tool shank on its bottom side and can have tool shoulders in the transverse direction, which tool shoulders are arranged set back with respect to the tool shank. The at least one friction reduction device is formed on the bottom side of the base body for reducing a frictional force between the bottom side and the tool holder upon a displacement of the lower tool in a longitudinal direction, such that a weight force of the lower tool acting on the tool holder, while applying a prestressing force in the direction of the weight force, causes a resulting normal force of the lower tool acting on the tool holder that is lower relative to the weight force.

The present invention is based on the insight that, for reducing wear of the lower tool and/or of the tool holder, it is not imperative for the lower tool and/or of the tool shoulders to completely lift off the tool holder. Generally, in the context of the present invention, a displacement force is described as the force which is necessary for the displacement of the lower tool on or within the tool holder in the longitudinal direction. The amount of the frictional force usually acts in the opposite direction of the direction of displacement. For displacing the tool, the displacement force must be greater than the frictional force. In the generally known manner, the frictional force $F_R$ can be approximated as $F_R=\mu*F_G$, with the aid of the vertically oriented weight force for $F_G$ of the lower tool in the direction of loading and a factor, the friction coefficient μ between a first and a second surface. For possible deviations from this generalization, the component forces, each working in different directions, can be combined vectorially in a manner known to the person skilled in the art.

Surprisingly, it has been shown that it is possible to reduce the frictional force between the bottom side of the lower tool and the tool holder, by means of the friction reduction device according to the invention performing an apparent reduction of the weight force of the lower tool acting on the tool holder. For this purpose, a prestressing force is applied to the tool holder by the friction reduction device. The support of the friction reduction device within the lower tool causes an apparent reduction of the weight force of the lower tool acting on the tool holder. The consequently resulting normal force of the lower tool acting on the tool holder is lower than the actual weight force of the lower tool, as a support of the amount of the applied prestressing force takes place via the friction reduction device onto the tool holder. This way, it becomes possible to avoid damage to the tool holder and/or the lower tool and/or a lower tool clamping relatively easily. This allows longer intervals of use of the lower tool and/or more frequent tool changes without damaging the tool holder or the lower tool. Thereby, maintenance intervals of the bending machine can also be extended. In addition to this, the frictional force of the displacement in the longitudinal direction during the tool change becomes reducible, whereby faster equipping speeds are possible. Moreover, a jamming of the lower tool in the tool holder can be avoided which can contribute to an increase in safety.

Furthermore, it can be useful if the at least one friction reduction device is arranged in a receiving space of the lower tool, which receiving space is, preferably respectively, provided therefor, such that the friction reduction device is configured to be movable with respect to the adjacent and/or surrounding bottom side in at least one direction, preferably in the direction of the weight force.

In doing so, it is possible to provide a separate receiving space in the lower tool for each friction reduction device, or to arrange multiple friction reduction devices in a common receiving space. The receiving space can, for example, be formed as a milling pocket within the lower tool, such that it is possible for the friction reduction device, in particular a sliding element, sliding wedge or also a roller, to be completely received. The extension of the receiving space in the longitudinal direction of the lower tool can be selected dependent on the embodiment of the friction reduction device, such that an at least partial displacement or movement of the friction reduction device within the receiving space is possible. By positioning the receiving space in the tool shank of the lower tool and/or in the tool shoulders of the lower tool, a formation of the friction reduction device as an interfering contour can be avoided in the case of a tool clamping. Thus, a good application of force of a tool clamping onto the lower tool can be ensured. Furthermore, the use of an automated change system, for example by means of a robot, is facilitated.

Furthermore, it can be provided that the friction reduction device comprises an adjustable spring element for adjusting the amount of the prestressing force.

In this regard, the adjustable spring element can be formed, for example, as a leaf spring, disk spring, helical spring or also as a resilient plastic body or the like. It has proven advantageous that one side of the spring element supports itself on the lower tool and pretensions a sliding element, a sliding wedge and/or a roller with a pre-definable spring force in the direction of the weight force of the lower tool and/or in the direction of loading. In certain cases, it may be advantageous if the possible maximum spring force of the spring element is greater than the weight force of the lower tool. In this regard, it is at the discretion of the person skilled in the art to achieve an optimal designing of the adjustability of the spring element according to the existing geometrical conditions. By way of example, the spring force of a spring element formed as a leaf spring can very easily be determined by means of a bearing length, which is adjustable from the outside. In a similar manner, the adjustability of a, e. g. a helical spring can be changed by means of the rotating device for adjusting the spring force. The possibility to adjust the amount of the prestressing force allows the person skilled in the art to realize faster equipping speeds and to significantly reduce the damage to the lower tool and/or the tool holder. A further advantage is that multiple friction reduction devices can have different prestressing forces, whereby the geometrical conditions of the lower tool and the distribution of the weight force can be specifically taken into account.

Furthermore, it can be provided that the prestressing force is at least 20% of the weight force of the lower tool.

Surprisingly, it has been shown in the case of lower tools that a reduction of the weight force of the lower tool acting on the tool holder of a sum of at least 20% can already cause a significant reduction of the surface damage. Depending on the tool weight and/or the length extension and/or where the center of gravity is, a variation of the weight force acting on the respective friction reduction device can occur. In this regard, it can be advantageous to pretension the friction reduction devices with different prestressing forces, in order to compensate for e. g. an eccentric center of gravity in the transverse and/or longitudinal direction of the lower tool to the effect that a jamming of the lower tool in the tool holder is avoided. A distribution of the weight force of the lower tool of 20 to 50% as prestressing force acting on the friction reduction device has proven particularly advantageous. Greater prestressing forces up to a prestressing force that is greater than the weight force of the tool are also conceivable and can be advantageous in certain applications.

An embodiment according to which it can be provided that a wear sensor, preferably connected to a system control, for monitoring a minimum thickness of a sliding element and/or a sliding wedge and/or a coating of the friction reduction device is arranged within the lower tool, is also advantageous.

In this regard, the wear sensor can be configured as an optical and/or mechanical sensor and should have a sight and/or contact connection that is as direct as possible to the sliding element, the sliding wedge, the roller and/or their optimal coating. The wear sensor allows a detection of the still available coating and/or of the thickness, which can be made detectable to the sensor e. g. by means of suitable markings. In doing so, possible damage to the lower tool and/or the tool holder can be avoided by a timely replacement of the sliding element, sliding wedge, the roller and/or the coating. This increases the safety and allows defined working and/or maintenance intervals. In this regard, it may be advantageous to achieve the current supply of the wear sensor for example by means of a lower tool clamping. Here, it is also conceivable that a data transfer to the system control is performed via such a contacting.

According to a further development, it is possible that a wireless transmission device, which is connected to the wear sensor, is formed in the lower tool and/or the tool holder for transmitting the wear data to the system control.

Hereby, a very effective protection of the wear sensor within the lower tool can be ensured, and possible contact points are protected against possible contamination and/or damage.

Moreover, it can be useful if a fixation means, preferably configured to be actuatable without tools, is configured so it can be coupled to the lower tool for securing the friction reduction device against falling out.

Here, e. g. relatively simply designed screws can be used as fixation means for fixating the sliding element or a sliding wedge in the friction reduction device. Likewise, clamping or locking elements such as an openable flap having a passage for e. g. a roller or a sliding wedge on the bottom side are conceivable. The fixation means can be configured such that it permits an at least partial movement of the sliding element, sliding wedge or the roller in the direction of loading and/or longitudinal direction. Hence, the function of the friction reduction device is not impeded while the friction reduction device is still efficiently secured in the lower tool against falling out during a tool change.

Furthermore, it can be provided that the at least one friction reduction device is arranged to be aligned in the direction of loading and/or in the transverse direction on both sides of the lower tool.

The formation of multiple friction reduction devices along the bottom side in the longitudinal direction on the tool shank can be used for an optimal load distribution and/or reduction of the weight force of the lower tool. By distributing the weight force and/or the prestressing force among multiple support points, the local surface pressure on the respective friction reduction device can be prevented. Hereby, the period of use of the friction reduction device can be extended and an excessive wear of a sliding element can be obviated. Analogously to this, it can be an advantage, depending on the location of the center of gravity of the lower tool in the longitudinal and, in particular, in the transverse direction, to provide at least one friction reduction device, for example in the tool shoulders.

Furthermore, it can be provided that the friction reduction device has a, preferably elastic, coating in at least the direction of loading for contacting the tool holder surface.

Using such a coating allows a targeted coordination of the required strength and/or friction properties such as a defined friction coefficient μ. Likewise, the suitable selection of the coating and its coating thickness can serve for optimizing the elastic properties with respect to the impact of the prestressing force. The coating can be formed e. g. as a resilient material such as rubber and may simultaneously develop an effect as the aforementioned spring element. This can entail particular advantages if the sliding element of the friction reduction device is formed as a roller. Moreover, such a coating can be replaced relatively easily if needed and/or if a minimum thickness is reached, which in turn entails considerable cost and time advantages. In particular, synthetic plastics, preferably resistant to oil and/or solvents, such as PTFE, PEEK and the like are envisaged. Hereby, a damage to the lower tool and/or the tool holder can be reduced while still achieving a high resistance of the sliding element or sliding wedge or of the coating.

According to a particular embodiment, it is possible that the friction reduction device is formed as a sliding element, wherein the friction coefficient of the sliding element with respect to the tool holder has a lower friction coefficient μ2 than the friction coefficient of the lower tool with respect to the tool holder μ1.

Using such a sliding element and applying the prestressing force allows a transfer of the majority of the weight force of the lower tool via e. g. a low-friction surface of the sliding element. Hereby, the frictional force can be significantly reduced in the case of a displacement in the longitudinal direction. Furthermore, a damage to the lower tool and/or the tool holder is efficiently avoidable as the wear of the friction is borne partially, preferably completely, by the sliding element. Here, the condition $\mu_1 \geq \mu_2$ has proven particularly advantageous. Such sliding elements can have a flat, but also vaulted, support surface in the direction of the tool holder. The sliding element can have a coating on the bottom side in the direction of the tool holder, or it can also be formed to be integral. Analogously to the above mentioned examples of the coating, suitable plastics can also be used for the sliding element. However, it is also conceivable that the sliding element consists of a metal and is provided with a coating on the surface, which coating makes for the desired friction properties, in particular the friction coefficient $\mu_2$. A sliding element can be configured to be movable within the receiving space partially along the longitudinal direction, and in a particular embodiment also be formed as a sliding wedge.

According to an advantageous further development, it can be provided that the sliding element and/or the coating of the sliding element has slanted and/or rounded edges.

This measure can significantly reduce the risk of jamming upon displacement of the lower tool and contributes to a protection of the lower tool and the tool holder. In particular, it can be advantageous if two wedge planes, which are oblique in the longitudinal direction relative to a plane of the tool holder, are formed within the receiving space, and the friction reduction device is formed as a sliding wedge that is movable along said wedge planes. In this regard, the friction coefficient of the sliding wedge with respect to the wedge planes is to have a lower friction coefficient than the friction coefficient of the sliding wedge with respect to the tool holder $\mu_2$.

The functional principle of such a sliding wedge substantially corresponds with the sliding element described above. The prestressing force can be applied to the sliding wedge analogously to the sliding element, whereby a considerable proportion of the weight force can be transferred from the at least one sliding wedge to the tool holder. By selecting the friction conditions and/or friction coefficient as described, the fact that the lower tool supports itself, in addition to the spring element, on the wedge planes on the friction reduction device can be utilized upon the displacement of the lower tool. Due to the lower friction coefficient $\mu_3$ between the wedge plane of the lower tool and the sliding wedge, said support can, in the case of a suitable selection of the friction coefficients between sliding wedge and the tool holder $\mu_2$, in coordination with the friction coefficient between the lower tool and the tool holder $\mu_1$, lead to a significant "relief" of the contacting areas of the lower tool on the tool holder. The condition $\mu_1 \geq \mu_2 > \mu_3$ has proven particularly advantageous as, in a borderline case, the lower tool is guided upwards in the case of displacement in the longitudinal direction along the wedge planes and can even lose contact with the tool holder. This way, a direct contact of the lower tool and the tool holder can be circumvented. The damage to the lower tool and/or the tool holder becomes avoidable by means of a relatively favorable and easy-to-replace sliding wedge and/or coating of the sliding wedge bearing the wear.

Alternatively to this, it can be provided that two wedge planes, which are oblique relative to the surface of the tool holder in the longitudinal direction, are formed within the receiving space, and the friction reduction device is formed as a roller. In this regard, a roller axle is formed so as to be movable along the wedge planes, and the receiving space is delimited in the longitudinal direction by means of a stop, and the friction coefficient of the roller axle with respect to the wedge planes has a lower friction coefficient $\mu_4$ than the friction coefficient of the roller with respect to the tool holder $\mu_2$ and the friction coefficient of the roller with respect to the tool holder is $\mu_2$ higher than the friction coefficient of the lower tool with respect to the tool holder $\mu_1$.

The locally higher surface pressure of the roller relative to the lower tool due to the smaller support cross-section allows a consistently good contact of the friction reduction device and the tool holder. Analogously to the idea of the sliding wedge and/or the sliding element described above, it is envisaged that the prestressing force of the friction reduction device leads to the weight force of the lower tool being at least partially transferred from the roller to the tool holder. Surprisingly, it has been shown that a resilient coating of the roller, which can make up a proportion of about 10 to about 80% of the radius of the roller, can develop an effect as spring element. The resiliently designed roller can therefore apply the required prestressing force and remains in the static, i. e. motionless, condition due to the weight force in the center of the receiving space. An inadvertent displacement of the lower tool is therefore impossible.

The receiving space is arranged in the longitudinal direction to be facing away from the tool holder in the direction of loading, such that a rest position of the roller and/or roller axle is provided. In the longitudinal direction, it is advantageous if the receiving space is dimensioned to be sufficiently large, so that a deflection of the roller along the longitudinal direction can take place. The selection of the friction conditions with a ratio of $\mu_2 \geq \mu_1 > \mu_4$ can result in the roller, in the static case, always returning into the rest position. By means of suitable selection of the material and/or friction coefficient and/or elastic properties of the roller and/or the coating, it can be achieved that, in case of a displacement of the lower tool in the longitudinal direction, a sliding along of the lower tool on the roller takes place. The weight force of the lower tool is thus transferred at least partially to the roller via the roller axles. Due to the comparably low rolling resistance, the rollers can contribute to a facilitated displacement in the longitudinal direction.

For particularly long displacement paths, it can be advantageous that, in the longitudinal direction, the stop of the receiving space is also formed as a roller, in order to prevent a jamming of the roller and/or roller axle. Due to the slanted and/or oblique position of the wedge planes in the longitudinal direction relative to the bottom side and/or the tool holder surface, even a complete unloading of the contact areas of the lower tool may be effected, whereby the reduction of the resulting normal force of the lower tool acting on the tool holding region takes place completely, so to speak. This case may occur when the lower tool supports itself on the roller axles along the slanted wedge planes during displacement in the longitudinal direction and thus, a lifting of the lower tool is achieved in a borderline case. Upon reaching the target position in the longitudinal direction on the tool holder, a kind of self-centering of the friction reduction device can take place due to the very low frictional forces and/or the low friction coefficients $\mu_4$ of the roller axle with respect to the wedge planes. The resiliently formed roller and/or the coating, which effect corresponding restoring forces, also contribute to this. The roller axle can be secured, from the bottom side, against falling out by means of a fixation means which can be e. g. a flap or a rail. In the described manner, a roller movable in the direction of loading and/or the longitudinal direction can be used very advantageously and easily for adjusting the prestressing force and for avoiding a damage to the longitudinal direction and/or the tool holder.

In the formation of the sliding element of the friction reduction device as a sliding wedge and/or roller, it is the responsibility of the person skilled in the art to select the angle of the wedge planes. The wedge planes can be designed, in addition to straight, steadily inclining planes, also as a kind of circular segment, in order to facilitate the self-centering of the sliding wedge and/or the roller.

Furthermore, it can be provided that the weight force of the lower tool is transferred completely from the friction reduction device to the tool holder.

This can be carried out by means of a prestressing force which is greater than the weight force of the lower tool, or also by means of the selection described above of the friction coefficients, wedge angles etc. By this measure, a complete reduction of the friction of the lower tool on the tool holder can be achieved. The lower sliding friction of the sliding element and/or sliding wedge, and/or the lower rolling friction of the friction reduction device can, in the respective cases, decidedly increase the service life of the lower tool and/or of the tool holder. Moreover, the sliding elements, sliding wedges, rollers and/or their coatings can be replaced relatively easily and cost-effectively. In total, significant cost advantages can result from this, and the safety of use for the operator can be increased.

For the purpose of better understanding of the invention, it will be elucidated in more detail by means of the figures below.

Figure 3:
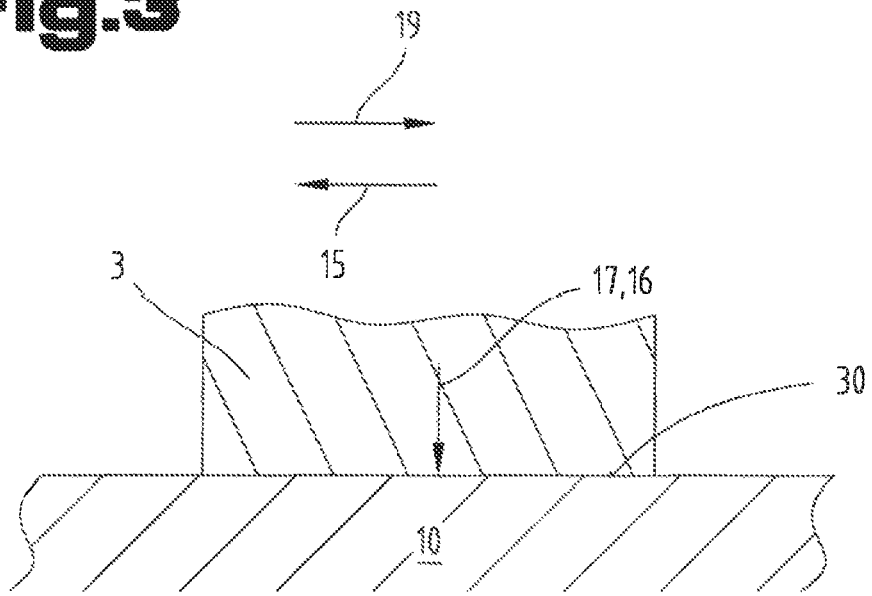
Figure 2:
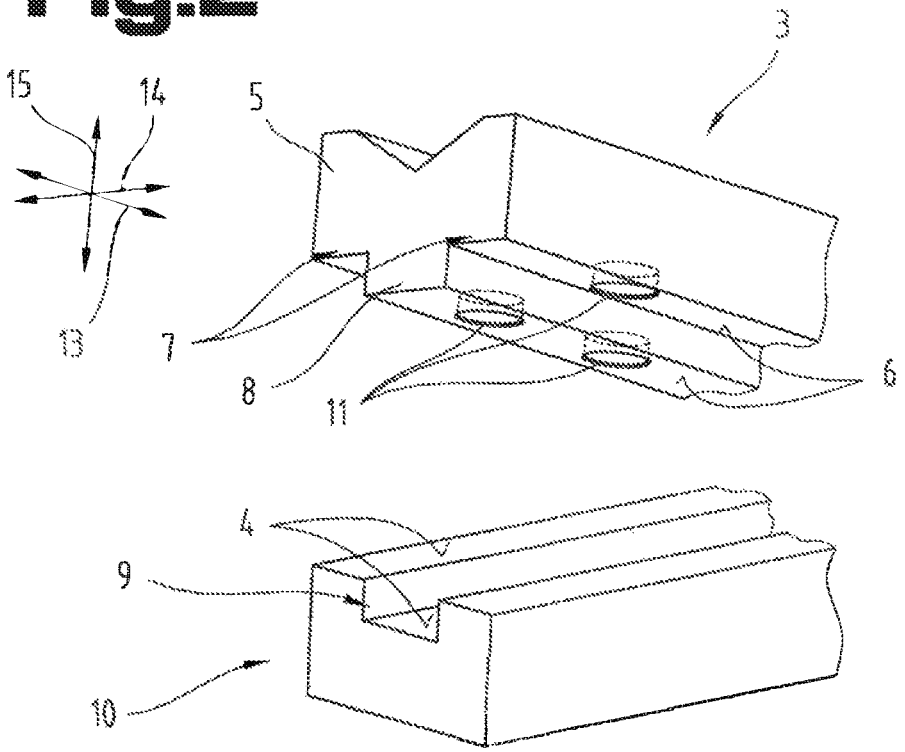
Figure 4:
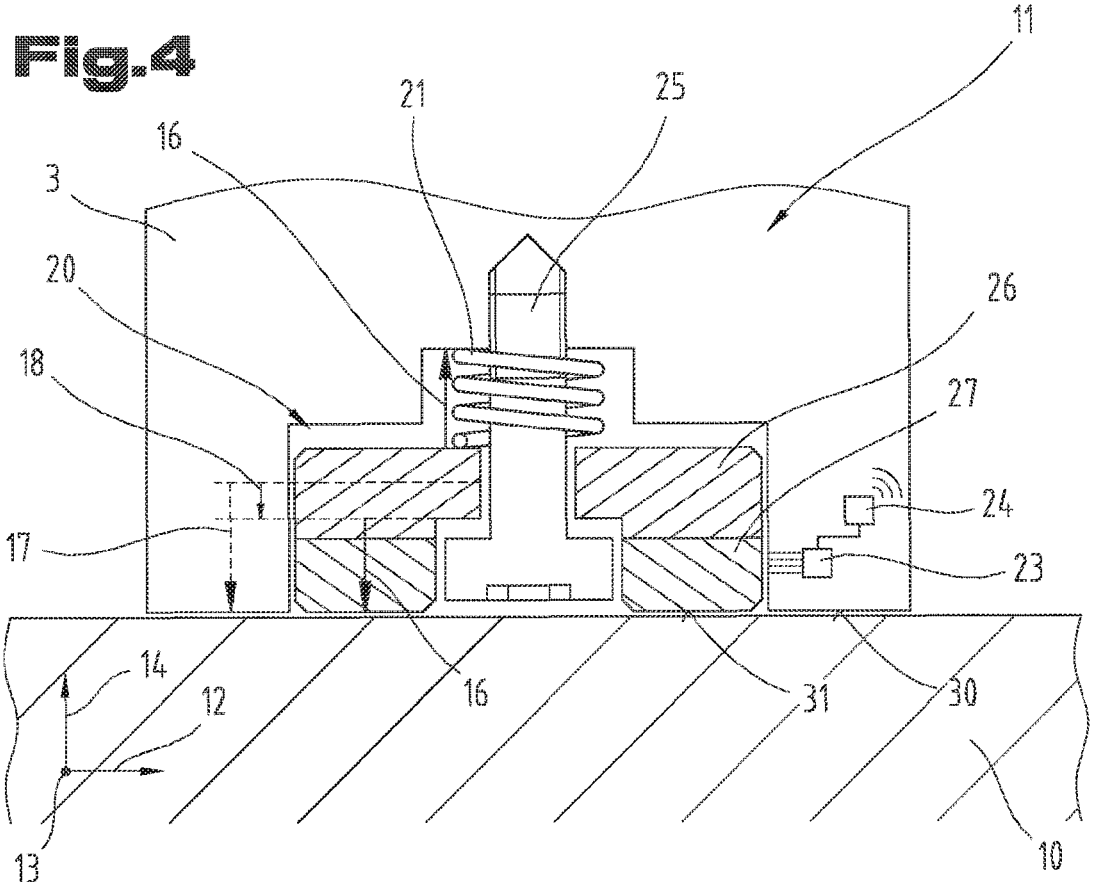

These show in a respectively very simplified schematic representation:

FIG. 1 an example of a bending machine;

FIG. 2 a schematic exploded view of a lower tool having friction reduction devices and tool holder;

FIG. 3 a schematic representation of the general force ratio upon frictional contact of two bodies;

FIG. 4 a schematic representation of an exemplary embodiment of a friction reduction device for applying a pretension with a sliding element;

FIG. 5 a schematic representation of an exemplary embodiment of a friction reduction device for applying a pretension with a sliding wedge;

FIG. 6 a schematic representation of an exemplary embodiment of a friction reduction device for applying a pretension with a roller.

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

In FIG. 1, a schematic representation of a bending machine 1 having a system control 22, an upper tool 2 and a lower tool 3 is shown, which is arranged on a tool holder 10. The schematic representation further shows the substantially vertical direction of loading 14 as well as the longitudinal direction 12, along which the lower tool 3 is to be displaceable in a guide slot 9 of the tool holder 10. Further, it can be seen that the transverse direction 13 is orthogonal to the longitudinal direction 12 and/or direction of loading 14.

In FIG. 2, a schematic exploded view of a lower tool 3 having a base body 5 as well as tool shoulders 7 formed laterally in the transverse direction 13 can be seen. The base body 5 has a tool shank 8 for being received in the corresponding guide slot 9 of the tool holder 10. In FIG. 2, possible positions for the arrangement of the at least one friction reduction device 11 can be seen. As is shown schematically, multiple friction reduction devices 11 can be formed in the longitudinal direction 12 in receiving spaces 20, which are respectively provided therefor, on the bottom side 6 of the lower tool 3. Moreover, it is possible to provide a friction reduction device 11 on the bottom side 6 of the lower tool 3 in the tool shoulders 7. Friction reduction devices 11 arranged like this can, for support and/or an momentum compensation, be used for avoiding an unwanted tool jamming in the case of an eccentric, meaning arranged to deviate from a vertical axis of the tool holder, center of gravity of the lower tool 3.

In FIG. 3, a schematic representation of the occurring force ratios of a lower tool 3, which contacts a tool holder 10, is shown. Usually, the estimate of a frictional force 15 can be performed using the product of the weight force 17 with a friction coefficient $\mu_1$ 30 between the lower tool 3 and the tool holder 10. The displacement force 19 in the longitudinal direction 12 must be greater than the frictional force 15. As is evident from FIG. 3, the entire weight of the lower tool 3 normally weighs on a region of the tool holder 10 as weight force 17.

The lower tool 3 according to the invention is explained with the aid of some schematic representations of FIGS. 4 to 6 in combination with FIGS. 2 and 3. In order to make the frictional force 15 between the bottom side 6 and the tool holder 10 possible in the case of a displacement of the lower tool 3 in the longitudinal direction 12, a prestressing force 16 is applied according to the invention in the direction of the weight force 17 by means of the friction reduction device 11. As can be seen schematically in FIG. 4, according to the invention, a friction reduction device 11 is arranged in a receiving space 20 of the lower tool 3. The weight force 17 of the lower tool 3, which force acts on the tool holder 10, is seemingly reduced to a resulting normal force 18 by the application of a prestressing force 16 by means of one friction reduction device 11 each, wherein the application of the weight force 17 takes place at least partially via the friction reduction device 11. As is shown schematically in FIGS. 4, 5 and 6, the dashed arrow of the weight force 17 can be reduced to the resulting normal force 18 by means of the prestressing force 16 which acts on the sliding element, a sliding wedge or a roller. The arrow lengths can be understood as a graphic illustration of the amount of the individual forces. Thus, a majority of the weight force 17 can be transferred to the tool holder 10 via the friction reduction device 11. The sliding element 26 shown in FIG. 4, is configured to be displaceable in the direction of the application of force and/or the direction of loading 14. The application of the prestressing force 16 to the sliding element 26 is carried out by a spring element 21 which is depicted, by way of example, as a spiral spring. A fixation means 25, which is depicted, by way of example, as a screw, allows for a clearance of the sliding element 26 in the direction of loading 14 and/or the longitudinal direction 12 while preventing a falling out of the friction reduction device 11 upon removal of the lower tool 3.

As an optional possibility, the sliding element 26 is designed having a coating 27 in FIG. 4. Moreover, slanted edges of the coating 27 as well as of the sliding element 26 can be seen. Furthermore, it can be seen from FIG. 4 that a wear sensor 23 is arranged within the lower tool 3, such that at least one side of the sliding element 26 and/or of an optional coating 27 can be detected. Upon reaching a minimum thickness of the sliding element 26 and/or the coating 27, a signal can be sent, preferably by means of a wireless transmission device 24, to a system control 22.

For the ease of understanding, the principle according to the invention is briefly explained by reference to the following calculation example of the frictional force 15, $F_R$, on the basis of exemplary values and is to be understood analogously for all exemplary embodiments in combination with FIG. 1 to FIG. 6:

- weight force 17 of the lower tool 3=$F_G$=200 N;
- prestressing force 16 of two friction reduction devices 11=$F_V$: 50N+50 N=100 N;
- resulting normal force 18=$F_N$=$F_G$−$F_V$=100 N;
- friction coefficient $\mu_1$ 30 between lower tool and tool holder 30=0.5;
- friction coefficient $\mu_2$ 31 between friction reduction device and tool holder=0.2.

Normally, the frictional force 15 is equivalent to $F_R=\mu_1*F_G$=0.5*200 N=100 N, whereby a displacement force 19 of more than 100 N is necessary for displacing the lower tool 3. Assuming, in a simplified manner, that the reduction of the weight force 17 $F_G$=200 N by the prestressing force 16 $F_V$=100 N to a resulting normal force 18 by means of the friction reduction device 11 according to the invention is carried out by $F_N=F_G-F_V$=200 N−100 N=100 N, the occurring frictional force 15 of the overall system, and thus the required displacement force 19, can be reduced. The total frictional force $F_{R\text{-}Sum}$ can be estimated by putting together the component frictional forces of the lower tool $F_{R1}$ and of the sliding element $F_{R2}$. Therefore, the following applies:

$$F_{R\text{-}Sum}=F_{R1}+F_{R2}=\mu_1*F_N+\mu_2*F_V=0.5*100\text{N}+0.2*100\text{N}=70\text{N}.$$

In a specific example, this means that using two friction reduction devices 11, each of them applying a prestressing force 16 of 50 N, which is equivalent to 25% of the weight force 17 of the lower tool 3, that a reduction of the required frictional force 15 of 30% occurs. This example merely serves for illustrating the approach and the advantage of the lower tool 3 according to the invention, in particular the friction reduction device 11 formed and arranged according to the invention. With the aid of this simple example of the sliding element 26, it is possible for the person skilled in the art to transfer the necessary conclusions for the calculation and interpretation analogously to a sliding wedge 29 and/or a roller 35, which is why a detailed discussion is refrained from at this point.

Figure 5A:
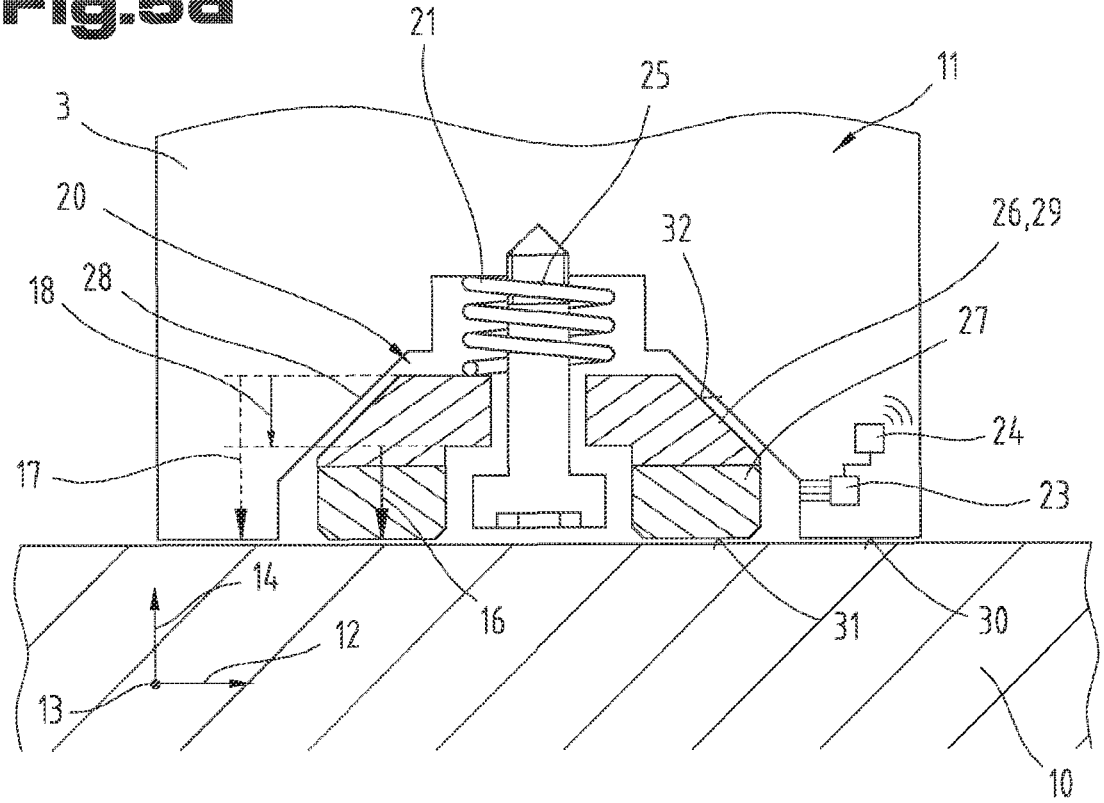

In FIG. 5, a further and potentially independent embodiment of a lower tool having a friction reduction device in the form of a sliding wedge 29 is shown. In FIG. 5*a*, the sliding wedge 29 is in the rest position and the lower tool 3 rests on the tool holder 10. Analogously to the description of the previously explained functional principle, a prestressing force 16 is applied, by means of the spring element 21, to the tool holder 10 via the sliding wedge 29. This leads to the reduction of the resulting normal force 18 relative to the weight force 17 of the lower tool 3. The sliding wedge 29 is configured to be movable in the longitudinal direction 12 and the direction of loading 14 within the receiving space 20. The sliding wedge has a friction coefficient $\mu_3$ 32 on the wedge planes 28 with respect to the lower tool. The friction coefficient between the coating 27 of the sliding wedge 29 to the tool holder 10 is shown as $\mu_2$ 31. The friction coefficient between the lower tool 3 and the tool holder 10 is shown as $\mu_1$ 30. Analogously to the description and the functionality of FIG. 4, a wear sensor 23 and a wireless transmission device 24 are schematically depicted and are not further explained with reference to the aforementioned discussion.

Figure 5B:
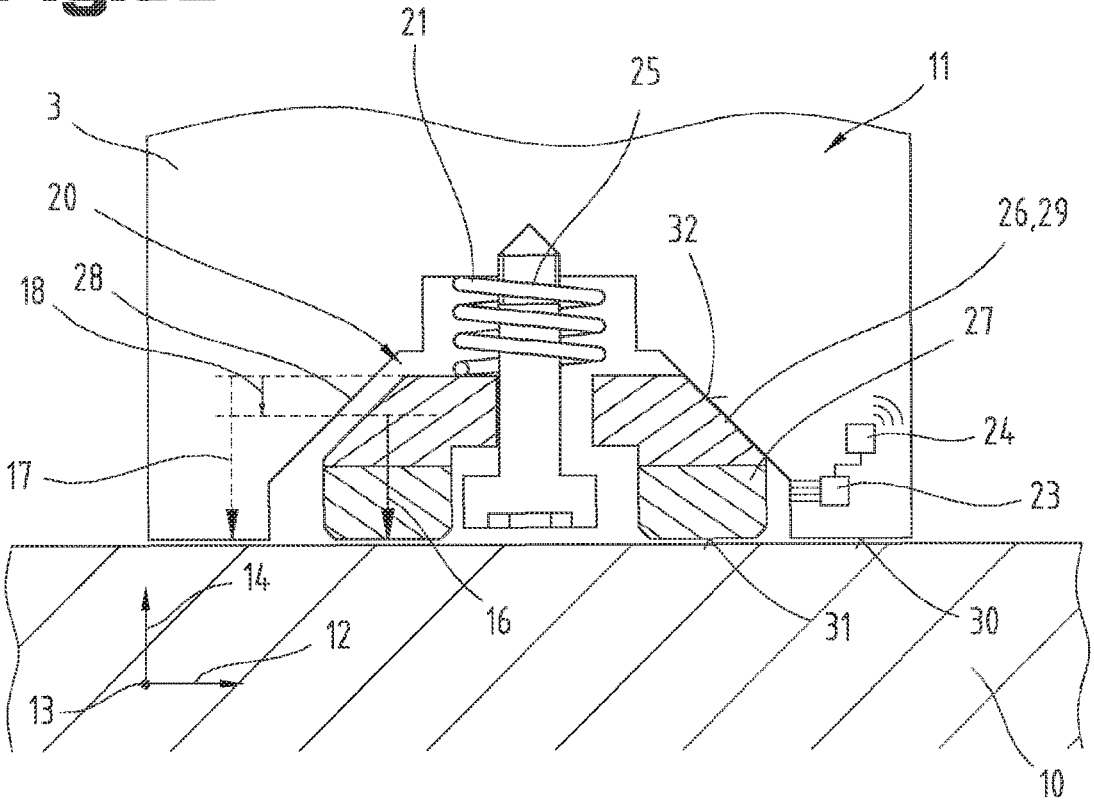

In FIG. 5*b*, a displacement of the lower tool in the longitudinal direction 12 is adumbrated. The application of the weight force 17 takes place on the wedge plane 28 on one side of the sliding wedge 29 as well as via the spring element 21 in the direction of the tool holder 10. As can be seen from FIG. 5*b*, the resulting normal force 18 can constitute a comparatively small proportion of the weight force 17. In a special case, it is possible that the entire weight force 17 is transferred to the tool holder 10 via the friction reduction device 11. Such a case can arise when the friction coefficient $\mu_3$ 32 is significantly lower than the friction coefficient $\mu_2$ 31 and $\mu_1$ 30. In the case of a displacement in the longitudinal direction 12 this can lead to the lower tool 3 being lifted due to the lower tool 3 sliding along on the wedge planes 28 on the sliding wedge 29. In this regard, the sliding wedge 29 has beveled upper sides which correspond with the wedge planes 28 in the depicted form. This way, a damage to the lower tool 3 and/or the tool holder 10 is avoided.

Figure 6A:
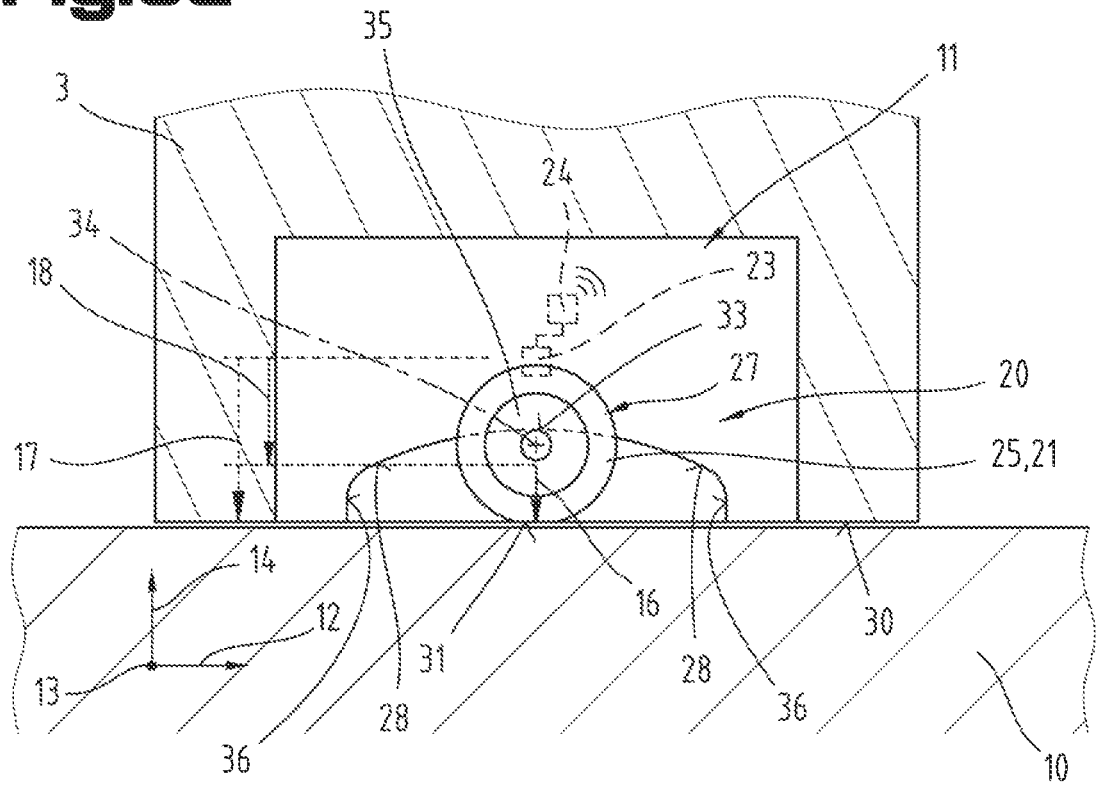

In FIG. 6, a further and potentially independent embodiment of a lower tool 3 having a friction reduction device 11 in the form of a roller 35 is shown. Again, equal reference numbers are used for equal parts as in the preceding FIGS. 1 to 5. In order to avoid unnecessary repetitions, it is pointed to/reference is made to the detailed description in FIG. 1 to FIG. 5 preceding it. In FIG. 6*a*, the rest position of the friction reduction device 11 and/or of the lower tool 3 is schematically depicted. The depicted roller 35 has a coating 27 in the radial direction. In this regard, the roller 35 is configured to be movable in the longitudinal direction 12 and the direction of loading 14 within the receiving space 20. The receiving space 20 is extended to the top, against the direction of loading 14, such that the roller 35 is movable freely around the roller axle 34. The roller axle 34 always contacts, in the transverse direction 13 the wedge 30 plane 28, In this regard, the coating 27 of the rollers 35 is configured to be resilient. However, it is also conceivable to configure the roller body to be resilient, whereby a coating 27 would be avoidable. In the case of a depicted roller 35 with a coating 27, said coating 27 and/or the roller body can function as a spring element 21. In this manner, a prestressing force 16 is applied analogously to the exemplary embodiments discussed above, whereby the weight force 17 of the lower tool 3 is reduced to the resulting normal force 18. Between the roller axle 34 and the lower tool 3, the frictional force 15 is determined locally by the friction coefficient μ4 33 and the proportion of the abutting weight force 17 of the lower 5 tool 3, As can be seen in FIG. 6*a*, the roller 35, in the static case, is arranged at a vertex of the receiving space 20 between the wedge planes 28 due to a self-centering effect. The receiving space 20 is delimited in the longitudinal direction 12 by a stop 36.

Analogously to the exemplary embodiments discussed above, a wear sensor 23 as well as a transmission device 24 is schematically adumbrated in FIG. 6. A repetition of the functionality is forgone here with reference to the discussion in FIGS. 4 and 5.

Figure 6B:
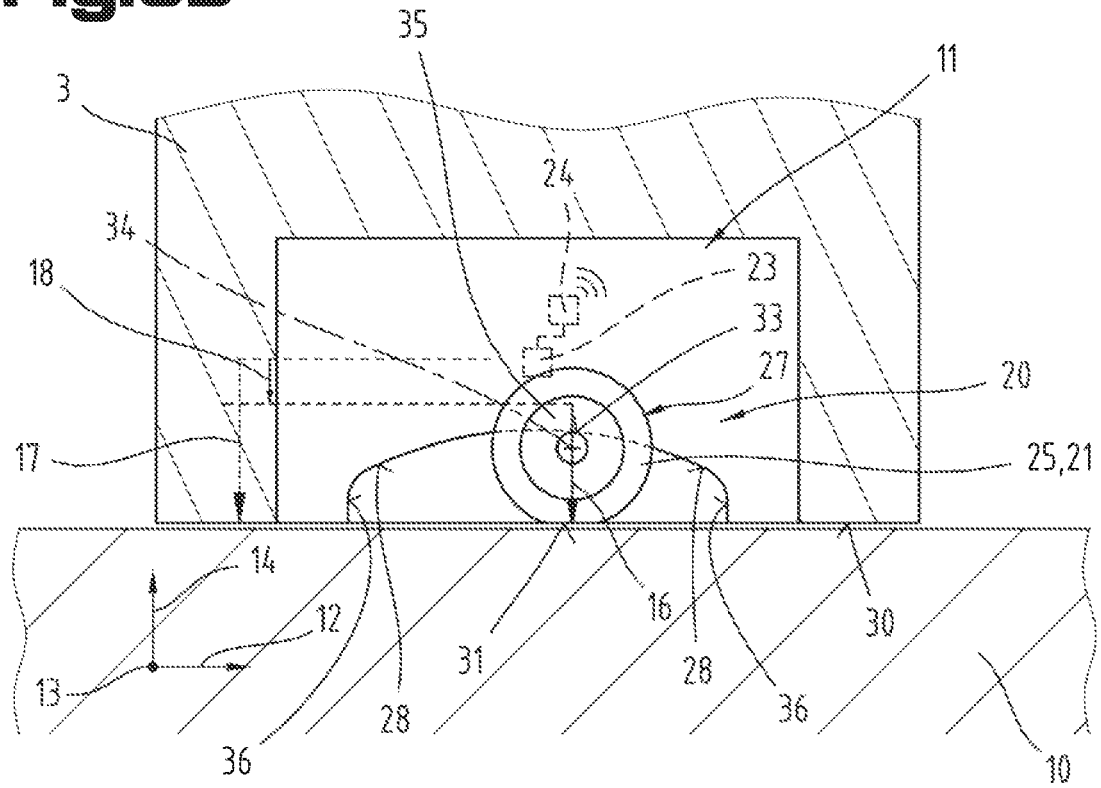

In FIG. 6*b*, the situation of the friction reduction device 11 during a longitudinal displacement is schematically depicted. In the event of the longitudinal displacement of the lower tool 3, a displacement of the roller axle 34 along the wedge plane 28 is caused, whereby the proportion of the prestressing force 16 relative to the resulting normal force 18 increases. In the borderline case, it is possible that the lower tool 3 is lifted in the contacting region with the tool holder 10. In this case, the lower tool 3 is fully supported on the tool holder 10 via the roller axle 34 and the roller 35. The low rolling resistance during the longitudinal displacement results in a reduction of the displacement force 19 and an effective reduction of the weight force 17 of the lower tool 3, which force acts on the tool holder 10. Upon reaching a target position in the longitudinal direction 12 on the tool holder 10, the roller can automatically assume the rest position between the wedge planes 28 due to the very low friction coefficients $\mu_4$ 33 relative to the friction coefficients 1 30 and/or μ2 31. This becomes possible due to the resiliently formed roller 35 and/or the resilient coating 27. The affixing of the fixation means 25, which can be affixed to the lower tool 3 from the bottom side 6 for example by means of a flap for fixating the roller axle 34, is not depicted.

All exemplary embodiments of FIGS. 4 to 6 are based on the inventive idea to reduce the weight force 17 of the lower tool 3 acting on the tool holder 10 to a resulting normal force 18 by applying a prestressing force 16 in the direction of the weight force 17 by means of the at least one friction reduction device 11. In certain cases, however, it may be advantageous that the amount of the prestressing force 16 is selected to be higher than the weight force 17 of the lower tool 3. In doing so, a complete transfer of the weight force 17 to the tool holder 10 can take place via the friction reduction device 11. This is possible, on the one hand, by adjusting the prestressing force 16 by means of spring element 21 (see especially FIG. 4), or, alternatively, it can be carried out by the lower tool 3 being supported on the wedge planes 28 during the longitudinal displacement of the lower tool 3 as is adumbrated in FIGS. 5 and 6.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the teaching for technical action provided by the present invention lies within the ability of the person skilled in the art in this technical field.

The scope of protection is determined by the claims. However, the description and the drawings are to be adduced for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

| List of reference numbers | |
|---|---|
| 1 | bending machine |
| 2 | upper tool |
| 3 | lower tool |
| 4 | tool holder surface |
| 5 | base body |
| 6 | bottom side |
| 7 | tool shoulder |
| 8 | tool shank |
| 9 | guide slot |
| 10 | tool holder |
| 11 | friction reduction device |
| 12 | longitudinal direction |
| 13 | transverse direction |
| 14 | direction of loading |
| 15 | frictional force |
| 16 | prestressing force |
| 17 | weight force |
| 18 | resulting normal force |
| 19 | displacement force |
| 20 | receiving space |
| 21 | spring element |
| 22 | system control |
| 23 | wear sensor |
| 24 | transmission device |
| 25 | fixation means |
| 26 | sliding element |
| 27 | coating |
| 28 | wedge plane |
| 29 | sliding wedge |
| 30 | friction coefficient μ-1 |
| 31 | friction coefficient μ-2 |
| 32 | friction coefficient μ-3 |
| 33 | friction coefficient μ-4 |
| 34 | roller axle |
| 35 | pulley |
| 36 | stop |

The invention claimed is:

1. A lower die for a bending machine, comprising:

a longitudinally extended base body extending along a longitudinal direction and comprising:

a tool shank created as a one-piece unit with the base body and disposed on a bottom side of the base body for being received in a guide slot of a tool holder;

tool shoulders formed by the bottom side of the base body and extending in a transverse direction to the longitudinal direction, wherein the tool shank is located between the tool shoulders and the tool shoulders are built to transfer vertically directed bending forces onto the tool holder, which vertically directed bending forces are generatable by the bending machine and are acting onto an upper side of the lower die; and a groove disposed on an upper side of the base body and having a V-shaped cross-section, the groove extending in the longitudinal direction; and at least one friction reduction device on the bottom side of the base body for reducing a frictional force between the bottom side of the base body and the tool holder in the event of a displacement of the lower die relative to the tool holder in the longitudinal direction and when no vertically directed bending forces are acting onto the upper side of the lower die, wherein the at least one friction reduction device is configured such that a weight force of the lower die acting on the tool holder, while a reactionary force is applied onto the lower die causes a resulting net force of the lower die onto the tool holder that is lower than the weight force, and wherein the at least one friction reduction device is arranged in a receiving space in the tool shoulders of the lower die such that the friction reduction device is configured so as to be movable with respect to the bottom side at least in the direction of the weight force.

2. The lower die according to claim 1, wherein the friction reduction device comprises an adjustable spring element for adjusting the reactionary force.

3. The lower die according to claim 1, wherein the reactionary force amounts to at least 20% of the weight force of the lower die.

4. The lower die according to claim 1, wherein the friction reduction device comprises a coating and the lower die further comprises a wear sensor connected to a system control, wherein the wear sensor is configured to monitor a minimum thickness of the coating of the friction reduction device.

5. The lower die according to claim 4, further comprising a wireless transmitter connected to the wear sensor for transferring wear data to the system control.

6. The lower die according to claim 1, further comprising a fixation means coupled to the lower die for securing the friction reduction device against falling out.

7. The lower die according to claim 1, further comprising a first side and a second side, wherein the friction reduction device is arranged so as to be aligned in a substantially vertical direction of loading and/or in a direction transverse to the substantially vertical direction of loading on the first side and the second side of the lower die.

8. The lower die according to claim 1, wherein the friction reduction device has a coating for contacting a surface of the tool holder.

9. The lower die according to claim 8, wherein the friction reduction device comprises a sliding element, wherein a friction coefficient of the coating with respect to the tool holder is lower than a friction coefficient of the lower die with respect to the tool holder.

10. The lower die according to claim 9, wherein the sliding element and/or the coating of the sliding element has slanted and/or rounded edges.

11. The lower die according to claim 9, further comprising two wedge planes which are oblique in the longitudinal direction and disposed within the receiving space, wherein the friction reduction device comprises a sliding wedge that is movable along said wedge planes, and wherein a friction coefficient of the sliding wedge with respect to the wedge planes is lower than a friction coefficient of the friction reduction device with respect to the tool holder sliding wedge.

12. The lower die according to claim 1, further comprising two wedge planes which are oblique in the longitudinal direction and disposed within the receiving space, and the friction reduction device comprises a roller having a roller axle configured to be movable along the wedge planes, and wherein the receiving space is delimited in the longitudinal direction by means of a stop, and wherein a friction coefficient of the roller axle with respect to the wedge planes is lower than a friction coefficient of the roller with respect to the tool holder and the friction coefficient of the roller with respect to the tool holder is greater than the friction coefficient of the lower die with respect to the tool holder.

13. A lower die for a bending machine, comprising:

a longitudinally extended base body extending along a longitudinal direction and comprising:

a tool shank created as a one-piece unit with the base body and disposed on a bottom side of the base body for being received in a guide slot of a tool holder;

tool shoulders formed by the bottom side of the base body and extending in a transverse direction to the longitudinal direction, wherein the tool shank is located between the tool shoulders and the tool shoulders are built to transfer vertically directed bending forces onto the tool holder, which vertically directed bending forces are generatable by the bending machine and are acting onto an upper side of the lower die; and, a groove disposed on an upper side of the base body and having a V-shaped cross section, the groove extending in the longitudinal direction; and at least one friction reduction device on the bottom side of the base body for reducing a frictional force between the bottom side of the base body and the tool holder in the event of a displacement of the lower die relative to the tool holder in the longitudinal direction and when no vertically directed bending forces are acting onto the upper side of the lower die, wherein the at least one friction reduction device is configured such that a weight force of the lower die acting on the tool holder, while a reactionary force is applied onto the lower die, causes the weight force of the lower die to be transferred completely from the friction reduction device to the tool holder, and wherein the at least one friction reduction device is arranged in a receiving space in the tool shoulders of the lower die such that the friction reduction device is configured so as to be movable with respect to the bottom side at least in the direction of the weight force.

* * * * *